United States Patent [19]

Peel

[11] 4,407,221

[45] Oct. 4, 1983

[54] COATING OF WIRE

[75] Inventor: Colin D. Peel, Auckland, New Zealand

[73] Assignee: New Zealand Wire Industries Limited, Auckland, New Zealand

[21] Appl. No.: 218,280

[22] Filed: Dec. 19, 1980

[30] Foreign Application Priority Data

Jan. 22, 1980 [NZ] New Zealand ..... 192668

[51] Int. Cl.[3] ..... B05C 11/02

[52] U.S. Cl. ..... 118/109; 118/122; 118/420; 118/429; 118/DIG. 19; 427/357; 118/428

[58] Field of Search ..... 118/109, 122, 125, DIG. 19, 118/420, 429, 428; 427/357

[56] References Cited

U.S. PATENT DOCUMENTS

| | | | |
|---|---|---|---|
| 435,760 | 9/1890 | Matteson | 118/109 |
| 1,073,297 | 9/1913 | Smelser | 118/109 |
| 2,413,216 | 12/1946 | Cone | 118/109 |
| 2,435,766 | 2/1948 | Baley | 118/109 |
| 4,191,127 | 3/1980 | Herman | 118/125 X |
| 4,269,887 | 5/1981 | Sonobe et al. | 428/280 |

*Primary Examiner*—John D. Smith
*Assistant Examiner*—Bernard F. Plantz
*Attorney, Agent, or Firm*—Abelman, Frayne & Rezac

[57] ABSTRACT

A method for wiping coated wire or strip which emerges vertically from a bath of molten metal, wherein the coated wire or strip, passes vertically through a pad wiping zone located above and spaced apart from the bath of molten metal. A pad wiping assembly is provided above the bath of molten metal and is adjustable by adjustment means from a position exterior the bath of molten metal.

The pad wiping assembly includes pad wiping material in the form of compressed non-combustible material and strip or wire wiping pads are replaceable.

12 Claims, 3 Drawing Figures

COATING OF WIRE

This invention relates to the coating of wire or strip.

Up until this time, various methods and apparatus have been used for wiping wire or strip, as it emerges from a hot dip metal coating bath.

In some cases, it has been known to draw the wire out of the metal coating bath at an angle, relative to the horizontal, and to provide wiping such as pad wiping apparatus, outside the bath.

This has brought about certain problems including the problem of gravity, which tends to cause the coating on the wire or strip to form into an oval coating rather than an even coating. It has also caused problems in so far as the wiping is concerned, in that there is a reasonable distance between the emergence of the wire or strip from the bath and the wiping apparatus, which is positioned outside of the bath.

Thus, in some cases, the wire or strip and coating sometimes cools before it reaches the pad wiping apparatus. In some cases, it has been necessary to provide means of maintaining the wire or strip at a certain temperature or means of reheating the wire or strip, following its emergence from the bath and prior to the pad wiping.

Other methods and apparatus which have been used, include gas wiping, the wiping zone consisting generally of a quantity of gravel contained within the chamber through which a gas is pumped. Also, charcoal wiping, the wire or strip emerging vertically and passing slowly through a mound of charcoal floating on the surface of the coating bath.

In the case of gas wiping and charcoal wiping, it is generally found that the wire or strip is thickly coated, whereas it is usually desired to provide a relatively thin or fine, even coating over the wire or strip, as can be provided by pad wiping.

It is an object of this invention to provide an efficient and acceptable method and apparatus for the wiping of metal wire or strip.

Other objects of this invention will become apparent from the following description.

According to one aspect of this invention, there is provided a method of wiping wire or strip, emerging vertically from a bath of molten metal; characterised in that the wire or strip passes vertically through a pad wiping zone, above said bath of molten metal.

According to a further aspect of this invention, there is provided apparatus for wiping wire or strip emerging vertically from a bath of molten metal; including a pad wiping zone located vertically above said bath of molten metal.

Figure 1:
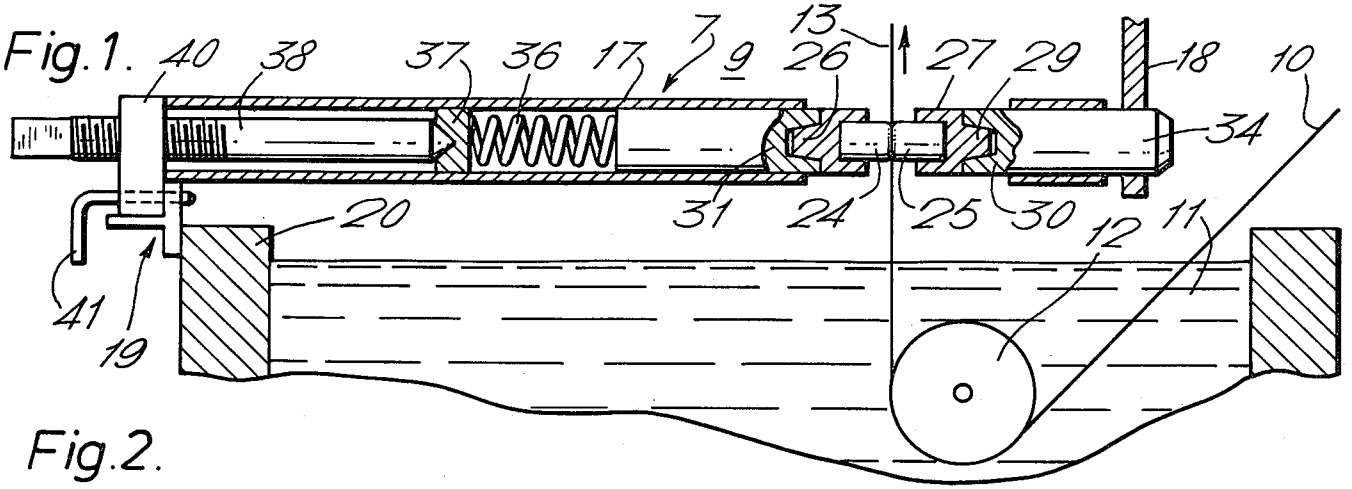

The invention will now be described by way of example only, and with reference to the accompanying drawings wherein:

FIG. 1: is a side elevational view of a form of a pad wiping arrangement of the invention.

Figure 2:
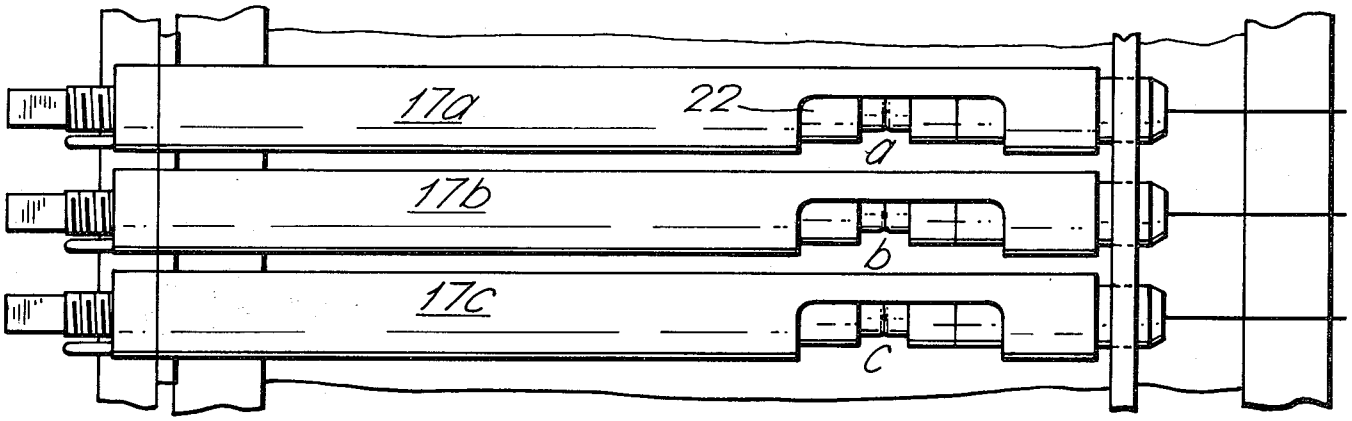

FIG. 2: is a top plan view of the pad wiping arrangement as shown in FIG. 1 of the drawings.

Figure 3:
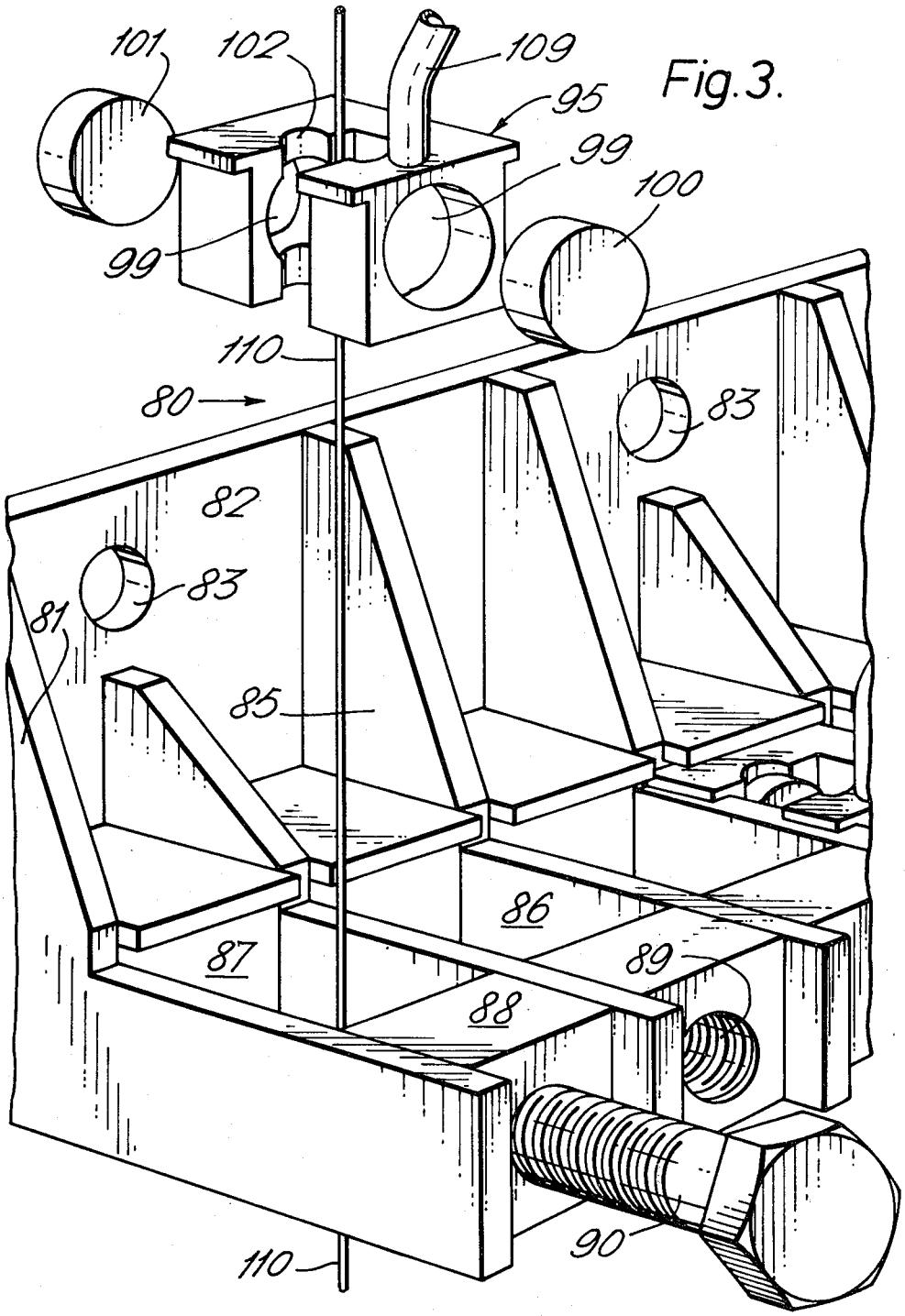

FIG. 3: illustrates a pad wiping rig having replaceable cartridges, according to a further form of the invention.

The present invention relates to the wiping of coated wire or strip, reference will be made throughout the specification and with reference to the drawings, to wire. It should be appreciated however, that the invention has application to both wire and strip and the reference to wire is by way of example only.

Referring to FIG. 1 of the drawings, wire 10 passes into a bath of molten metal 11. Typically, the molten metal would be molten zinc as used in the galvanising of wire. This is by way of example only however, and other coating materials can be used.

The wire 11 passes into the molten metal and around a sinker wire or skid 12 to emerge from the bath as vertical wire 13. The vertical wire 13 emerges in the substantially vertical direction of the arrow shown in FIG. 1 of the drawings, and retain a surface coating of the molten metal 11 from the bath 10.

A pad wiping zone 9 is provided immediately above and spaced apart from the molten metal 11 in the bath 8.

The pad wiping zone 9 is generally indicated at 9, and is preferably adjacent to but spaced apart from and above the molten metal within the bath, so that the coated wire emerging from the bath has a minimum distance to travel before being wiped.

Referring to FIGS. 1 and 2 of the accompanying drawing, a pad wiping assembly 7 is shown located within the pad wiping zone, above the bath, the pad wiping assembly of FIG. 2 of the drawings showing spaced apart tubular housing members 17*a*, 17*b* and 17*c*.

FIG. 1 of the drawings shows a side elevational view of one tubular housing member 17.

The tubular housing members 17 are mounted above the surface of the molten metal 11 so as to control the thickness of the metal coating.

The elongate tubular housing member 17 is mounted at one end on a cross beam 18 extending above the surface of the bath and is mounted at the other end on a suitable mounting bracket 19 attached to the slip 20 of the bath. Other mounting means can however be used.

The tube 17 has a notch or recess 22 on one side thereof and within this recess 22 is located a pad wiping means, in the form of a pair of pads 24, 25 mounted within the pad holders 26, 27. Preferably, the pads are replaceably mounted within the pad holders or cateridges 26 and 27. Preferably, the pads are replaceably mounted within the pad holders 26 and 27. The pad holders have stems 29 capable of fitting into complementary recesses of mounting plugs 30 and 31.

The pads may be glued, bonded, frictionally engaged or otherwise secured in a suitable manner, to the mounting means 26 and 27.

The pads 24, 25 are preferably formed of a hard wearing pad wiping material, and are preferably of a compressed non-combustible material. For example, the pads can be constructed of an asbestos material suitably impregnated with graphite.

Alternatively, the pads may be constructed of an alumino silicate fibre material.

In this regard, reference is made to the invention described and claimed in our patent specification entitled—"Improvements in Or Relating to Materials for the Wiping of Coated Wire".

The mounting 18 shown in FIG. 1 of the drawings, extends across the bath and has a plurality of apertures 34 therein.

The beam 18 is conveniently the same beam as may be used to support the skids or roller. This beam could also be used to support equipment for gas or charcoal wiping.

This is however by way of example only.

The tube 17 is of cylindrical formation, while the mounting means 30 may be a rod or dowel capable of fitting within a recess 34.

The plug 31 is slidably mounted within the body of the tubular housing 17 and is in contact with a spring 36 which is in turn contacted by a cap or nesting cup 37 which is moved by suitable adjustment means 38. Conveniently, the adjustment means 38 consists of a lead screw which can be rotated by a suitable tool, for example a torque wrench, or spanner, from a position exterior of the bath.

Other suitable adjustment means exterior the bath can be provided and utilised.

A supporting flange 40 depends downwardly from the outer end of the tubular member 17, so as to rest on the bracket 19. A securing pin 41 or suitable securing means 41 pass through the flange and through a portion of the bracket to retain the tube in position relative to and above the bath. Other securing means can be used however.

As will be appreciated from FIG. 2 of the drawings, as described hereinbefore, a series of tubes 17*a*, 17*b* and 17*c* can be placed side by side above the bath to accommodate a series of vertically emerging wires as shown as a, b, c, in FIG. 2 of the drawings.

This is by way of example only however, and any number of tubular housing members can be utilised in the invention.

The beam 18 is provided at spaced apart locations with apertures 34 therein, so that the tubular housing members 17 can be located therewithin so as to span the bath in a substantially releaseable manner.

It should be appreciated that the tubular housing members can be removed and replaced as desired.

In use, actuation of the adjustment means 38 will cause actuation of the spring 36, to thus adjust the pressure on the pad holder 27 and the pad 24, to thus adjust the pad 24, and pad holder 26 relative to the pad holder 27 and pad 25, and relative to the wire 13 passing therebetween.

If desired, suitable adjustment means can also be provided in addition, or as an alternative, at the other end of the tubular housing member 17, so that the pad holder 27 and pad 25 are also adjustable.

Thus, on actuation of the lead screw 38, or some other means from a position exterior of the bath, the pads 24 and 25 are able to move apart from one another, so that a wire can be fitted therebetween the lead screw 38 then being adjusted to the required pad pressure, so that there is a desired pressure of a predetermined amount on the wire running between the pads 24 and 25.

When the pads 24 and 25 are to be replaced, the tubular housing members 17 can be taken away or removed from its position spanning the bath, and new pads and pad holders inserted, or pads repaired.

It is a particular advantage of this invention that the pressure of the pad or pads is able to be adjusted from a position exterior of the bath, rather than an operator leaning over the bath and thus coming into contact with the extreme heat of the bath.

Referring now to FIG. 3 of the accompanying drawings, an alternative embodiment of the invention is described with reference to said FIG. 3 of the drawings.

The pad wiping assembly is shown as 80, in FIG. 3 of the drawings. The pad wiping assembly 80 includes a carrier 81 having a rear face 82 which may be mounted on a suitable support beam (not shown) which can for example span the hot bath, in a demountable manner.

For example, apertures 83 can be provided, to be capable to be fitted over mounting pins on supporting beams spanning the bath.

Other means of mounting the carrier can however be used as desired.

The carrier 81 is provided with a plurality of flanges 85 extending outwardly from the rear wall 82 and having lower webs 86.

The inner ends of these webs 86 are spaced apart from one another by inner blocks 87, while the outer ends of the webs are spaced apart by outer blocks 88.

The outer blocks 88 are provided with threaded apertures 89 therethrough to accommodate a threaded adjustment member 90.

The blocks 87 and 88 thus define a recess or housing area which is adapted to locate and accommodate at least one cartridge.

In the preferred form of the invention such as shown by way of example only, in FIG. 3 of the drawings, a plurality of such housings are provided side by side, so that a plurality of such cartridges can be housed side by side to thus permit the pad wiping of a number of wires, in a side by side situation as they emerge vertically from a bath of molten metal.

The cartridge 95 is of a substantially block formation, having at least one substantially vertical bore 102 passing therethrough, which bore is provided with an open face, the cartridge having at least two spaced apart and substantially aligned horizontal bores, being of substantially circular formation, although this is by way of example only.

Each cartridge, is provided with a suitable mounting handle 109.

In use, pads are provided such as pads 100 and 101, formed of a suitable material such as hereinbefore described, preferably being a compressed non-combustible material.

Thus, the pads are inserted into the substantially horizontal bore, to extend inwardly into the vertical bore, so that the wire passing up through the vertical bore will pass between the pads 100 and 101.

On a cartridge being located and housed in carrier 81, the horizontal bores will align substantially with the adjustment member 90, such that when in place and when wire 110 has been passed through the vertical bore, to thus run between the pads extending inwardly from the substantially horizontal bore, adjustment or pressure on the adjustment member 90 will enable the pressure of the pads relative to one another, and to the wire or strip 110 passing therebetween to be adjusted.

The handle means 109, preferably is angled to extend away from the hot bath, so that the cartridge can be removed and the pads replaced or repaired as desired.

The adjustment means preferably extends outwardly away from the hot bath, and preferably is adjustable from the side of the hot bath, so that again it is unnecessary to bend over the hot bath or to come into contact with the hot bath, when removing or replacing the cartridge or pads, or when adjusting the adjustment means and thus the pressure of the pads relative to each other and the wire or strip.

The present invention has been described by way of example only, and improvements and modifications may be made to the invention, without departing from the scope thereof, as defined by the appended claims.

We claim:

1. A cartridge for use in wiping a filament emerging from a coating bath, said cartridge comprising:

an elongate, tubular housing member having a lateral opening;

first and second wiper members each supported by said housing member and positioned within said lateral opening;

means slidably mounting at least one of said wiper members for movement relative to the other said wiper member and longitudinally of said housing member;

resilient biasing means carried by said housing and urging said movable wiper member towards and into juxtaposition with the other said wiper member, said biasing means including adjustment means carried by the housing and adapted to be actuated from a position exterior of said coating bath, said resilient biasing means and said adjustment means extending axially of said housing; and means carried by said housing member for supporting said cartridge above said coating bath with said wiper members positioned in the path of movement of said filament and which permit ready release of said cartridge from said coating bath without substantially disturbing that filament.

2. The cartridge of claim 1, in which said housing member is an elongate tubular member having a lateral opening formed therein through which said filament can extend in a direction transverse to said housing, the respective first and second wiper members being positioned within and supported by said housing and having wiper pads thereof positioned within the confines of said lateral opening, at least one of said wiper members being slidable longitudinally within said housing.

3. The cartridge according to claim 2, in which said resilient biasing means includes a spring acting on said one wiper member, and a threaded spindle acting on said spring and which extends axially within said tubular member to the exterior thereof through a threaded member carried by said tubular housing at the said opposite end thereof, rotation of said spindle acting to modify the bias exerted on said one wiper member by said spring.

4. The cartridge of claims 1, in which each said wiper member includes a support, and a pad consisting essentially of graphite impregnated asbestos carried by said support.

5. The cartridge of claim 1, in which each said wiper member includes a support, and a pad consisting essentially of alumino silicate fiber carried by said support.

6. The cartridge of claim 1, in which each said wiper member includes a support, and a pad consisting essentially of compressed alumino silicate fiber carried by said support.

7. In an apparatus for simultaneously coating a plurality of filaments, and which includes a tank in which the coating material is contained, guides for guiding the respective filaments through said tank and said coating material and then vertically out of said tank;

a wiper mechanism for wiping excess coating material from said coated filaments emerging from said coating bath, said wiper mechanism comprising plural independent wiper cartridges each including an elongate, tubular housing member having a lateral opening;

first and second wiper members each supported by said housing member and positioned within said lateral opening;

means slidably mounting at least one of said wiper members for movement relative to the other said wiper member and longitudinally of said housing member;

resilient biasing means carried by said housing and urging said movable wiper member towards and into juxtaposition with the other said wiper member, said biasing means including adjustment means carried by the housing and adapted to be actuated from a position exterior of said coating bath, said biasing means and said adjustment means extending axially of said housing; and means carried by said housing member for supporting said cartridge above said coating bath with said wiper members positioned in the path of movement of said filaments and which permit ready release of said cartridge from said coating bath without substantially disturbing that filament.

8. The wiper mechanism of claim 7, in which said housing member of each cartridge is an elongate tubular member having a lateral opening formed therein through which said filament can extend in a direction transverse to said housing, the respective first and second wiper members of each cartridge being positioned within and supported by said housing and having wiper pads thereof positioned within the confines of said lateral opening, at least one of said wiper members of each cartridge being slidable longitudinally within said housing.

9. The wiper mechanism of claim 8, in which said resilient biasing means of each cartridge includes a spring acting on said one wiper member, and a threaded spindle acting on said spring and which extends axially within said tubular member to the exterior thereof through a threaded member carried by said tubular housing, rotation of said spindle acting to modify the bias exerted on said one wiper member by said spring.

10. The wiper mechanism of claim 7, in which each said wiper member of each cartridge includes a support, and a pad consisting essentially of graphite impregnated asbestos carried by said support.

11. The wiper mechanism of claim 7, in which each said wiper member of each cartridge includes a support, and a pad consisting essentially of alumino silicate fiber carried by said support.

12. The wiper mechanism of claim 7, in which each said wiper member of each cartridge includes a support, and a pad consisting essentially of compressed alumino silicate fiber carried by said support.

* * * * *